US007770363B2

(12) United States Patent
Monti

(10) Patent No.: US 7,770,363 B2
(45) Date of Patent: Aug. 10, 2010

(54) METHOD FOR FILLING CELLS OF A BLISTER STRIP WITH ARTICLES AND AN APPARATUS FOR IMPLEMENTING THE METHOD

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 168 days.

(21) Appl. No.: 12/181,444

(22) Filed: Jul. 29, 2008

(65) Prior Publication Data

US 2009/0056283 A1 Mar. 5, 2009

(30) Foreign Application Priority Data

Aug. 27, 2007 (IT) ..... BO2007A0592

(51) Int. Cl.
*B65B 3/24* (2006.01)

(52) U.S. Cl. ..... 53/475; 53/474; 53/539; 53/247

(58) Field of Classification Search ..... 53/475, 53/474, 539, 238, 246, 247, 260, 454
See application file for complete search history.

(56) References Cited

U.S. PATENT DOCUMENTS

| | | | | |
|---|---|---|---|---|
| 3,499,262 | A * | 3/1970 | Thurston et al. | 53/527 |
| 3,735,556 | A | 5/1973 | Dille et al. | |
| 4,677,808 | A | 7/1987 | Chenevard | |
| 4,832,180 | A * | 5/1989 | Ferrero | 198/468.3 |
| 5,611,193 | A * | 3/1997 | Farrelly | 53/475 |
| 7,073,312 | B2 * | 7/2006 | Battisti | 53/537 |
| 7,661,249 | B2 * | 2/2010 | Monti | 53/539 |
| 2004/0007442 | A1 * | 1/2004 | Monti | 198/538 |
| 2008/0222999 | A1 * | 9/2008 | Monti | 53/244 |
| 2008/0282646 | A1 * | 11/2008 | Gertitschke et al. | 53/244 |

FOREIGN PATENT DOCUMENTS

| | | |
|---|---|---|
| DE | 4208818 A1 | 9/1993 |
| EP | 0162933 A | 12/1985 |
| EP | 0163092 A | 12/1985 |

OTHER PUBLICATIONS

International Search Report.

* cited by examiner

*Primary Examiner*—Sameh H. Tawfik
(74) *Attorney, Agent, or Firm*—William J. Sapone; Coleman Sudol Sapone P.C.

(57) ABSTRACT

A method for filling cells of a heat-formed strip with corresponding articles, the strip being continuously advanced at a predetermined operating speed, comprising: collecting a plurality of articles which are in contact with each other and arranged in parallel rows; adjusting the position occupied by the collected articles in such a way that the articles are arranged in a same spatial arrangement as a same number of empty cells in a longitudinal region of the blister strip to be filled; transferring the articles to a position above the blister strip, the speed of advancement of the articles being gradually synchronized with the speed of advancement of the strip, in a centered position relative to corresponding underlying empty cells of the longitudinal region; releasing the articles into the empty cells of the longitudinal region; repeating these operating stages in order to fill at least a further longitudinal region, which is identical and adjacent to the longitudinal region, in such a way as to complete the filling operation for a longitudinal tract of the blister strip.

4 Claims, 5 Drawing Sheets

4
70
8
7
P3
W
Er
8
3
3A
P1
P2
2
9
3
5
8
1
30
8
6

METHOD FOR FILLING CELLS OF A BLISTER STRIP WITH ARTICLES AND AN APPARATUS FOR IMPLEMENTING THE METHOD

BACKGROUND OF THE INVENTION

This invention concerns the technical sector of blister pack manufacturing, with particular reference to the operating stages which are implemented, and the means which are employed, to insert articles such as pills, tablets, capsules and the like into a heat-formed blister strip.

In this sector the publication US 2007/0084141 is known, which discloses a type of apparatus for inserting small-sized articles into the cells of a blister strip.

This apparatus operates between a complex consisting of a hopper for loading the articles and an associated dosing channel, and a blister strip which is to be filled with articles, and comprises: a plurality of fill trays, each of which affords housings or seatings superiorly, the number and spatial arrangement of which reproduce a predetermined longitudinal tract of the blister strip; conveyor organs, which convey the fill trays along a ring-wound trajectory which is arranged on two levels, an upper level and a lower level, between a station for filling the seatings of the trays with the articles, and a station for transferring the articles which are loaded in the trays into the corresponding empty cells of a corresponding tract of strip; filling organs, which are provided in the filling station, for filling the seatings of each tray which transits in the station, which filling organs comprise means which cause the fill trays to vibrate and rotating brushes, arranged with an axis thereof transversal to the direction of advancement of the trays, for distributing the articles which are released by the dosing channel into the seatings of the advancing trays; and transfer organs, provided in the transfer station, comprising a sucker tray for transferring the articles which are contained in the seatings of each fill tray into the empty cells of a corresponding longitudinal tract of blister strip.

The blister strip is situated alongside the filling station and at the same height as the upper level thereof, thus enabling the trajectory of the sucker tray between the filling station and the blister strip to be minimized.

Once the fill tray has been emptied of the relative articles, it is lowered to the lower level and positioned at the initial part of the upper branch of an underlying conveyor which transfers the tray towards the terminal part of the conveyor, where suitable means raise the empty tray to the upper level.

The described apparatus is obviously complex, since it is provided with a series of fill trays which must be moved by means of suitable organs along a ring-wound trajectory, and with means which fill the housings of the trays with relative articles.

Blister strip format changeover, that is, the operation for varying the reciprocal arrangement of the cells provided in the strip, requires substitution of all the fill trays, with the attendant costs that this entails regarding both the time necessary to perform the substitution, and the need to stock series of fill trays, each series thereof corresponding to a format of the blister strip; format changeover for the blister strip also entails substitution of the sucker tray.

SUMMARY OF THE INVENTION

This invention obviates the above-described drawbacks.

An aim of this invention is to provide a method for filling the cells of a heat-formed strip, which method is of new conception, is constituted by an essential number of operating stages, and the implementation of which enables high standards of reliability and productivity to be achieved with relatively low costs compared with the advantages provided.

A further aim of this invention is to provide an apparatus which implements the above-mentioned method is reliable, functional, versatile and productive, and the costs of which are relatively low, compared with the advantages provided.

A further aim of this invention is to provide an apparatus conformed in such a way that it reduces the time necessary to adapt the apparatus to a new blister strip format, and limits the devices and/or interventions on these devices necessary to satisfy the requirements of the various formats of blister strips.

The aforementioned aims are achieved by means of a method for filling cells of a blister strip with corresponding articles, according to independent claim 1, and an apparatus for filling cells of a heat-formed strip with corresponding articles, according to independent claim 5.

The method for filling cells of a blister strip with corresponding articles, the blister strip being continuously advanced along an advancement direction at a predetermined operating speed, is characterized in that it includes in order: contemporaneously collecting a plurality of articles in reciprocal contact which are arranged in a plurality of distinct parallel rows, a predetermined number of articles destined for collection corresponding to each row; adjusting reciprocal positions occupied by the articles after collection in such a way that the articles are arranged in a same spatial arrangement as a same number of empty cells of a predetermined first longitudinal region of the blister strip; transferring the collected articles to a position which is above the blister strip and aligned with the first longitudinal region to be filled, and conveying the articles in a same direction as an advancement direction of the blister strip until synchronization with an operating speed of the blister strip is achieved, the articles being centered relative to the cells of the underlying first region; releasing the articles into corresponding cells of the first region; repeating the above-listed operating stages in order to fill cells of at least a second longitudinal region of the blister strip, which region is identical and adjacent to the first region, thus completing a filling of the cells of a longitudinal tract of the blister strip which the first and second regions constitute; repetition of the filling stages on further consecutive, longitudinal tracts of the blister strip.

The apparatus for filling cells of a heat-formed strip with corresponding articles, the heat-formed strip being advanced continuously at a predetermined operating speed in an advancement direction, is characterized in that it comprises: a plurality of channels which are constrained to the frame and which contain articles arranged in a row which, upon entering into reciprocal contact, accumulate near terminal sections of the channels, the terminal sections being mutually parallel; and a device, acting between the terminal sections of the accumulation channels and corresponding identical and adjacent longitudinal regions of the advancing blister strip, the device comprising gripping organs for contemporaneously collecting the articles contained in the accumulation channels, and for adjusting reciprocal positions occupied by the collected articles such that the articles are arranged in a same spatial arrangement as a same number of empty cells of a predetermined longitudinal region of the blister strip, the gripping and adjusting organs positioning above the strip, and following the strip until a velocity synchronization with the strip is achieved, centering the articles relative to the empty cells of a corresponding underlying longitudinal region and finally releasing the articles into the empty cells.

BRIEF DESCRIPTION OF THE DRAWINGS

The characteristics of the invention which have not been mentioned herein above will become more evident in the following description of a preferred embodiment thereof, in accordance with the claims and with the aid of the appended tables of drawings, in which:

DESCRIPTION OF THE PREFERRED EMBODIMENTS

With reference to the attached tables of drawings, the reference number 1 indicates a heat-formed blister strip which is conveyed continuously by means of known systems (not shown) in a direction of advancement W and at a predetermined operating speed.

Figure 1:
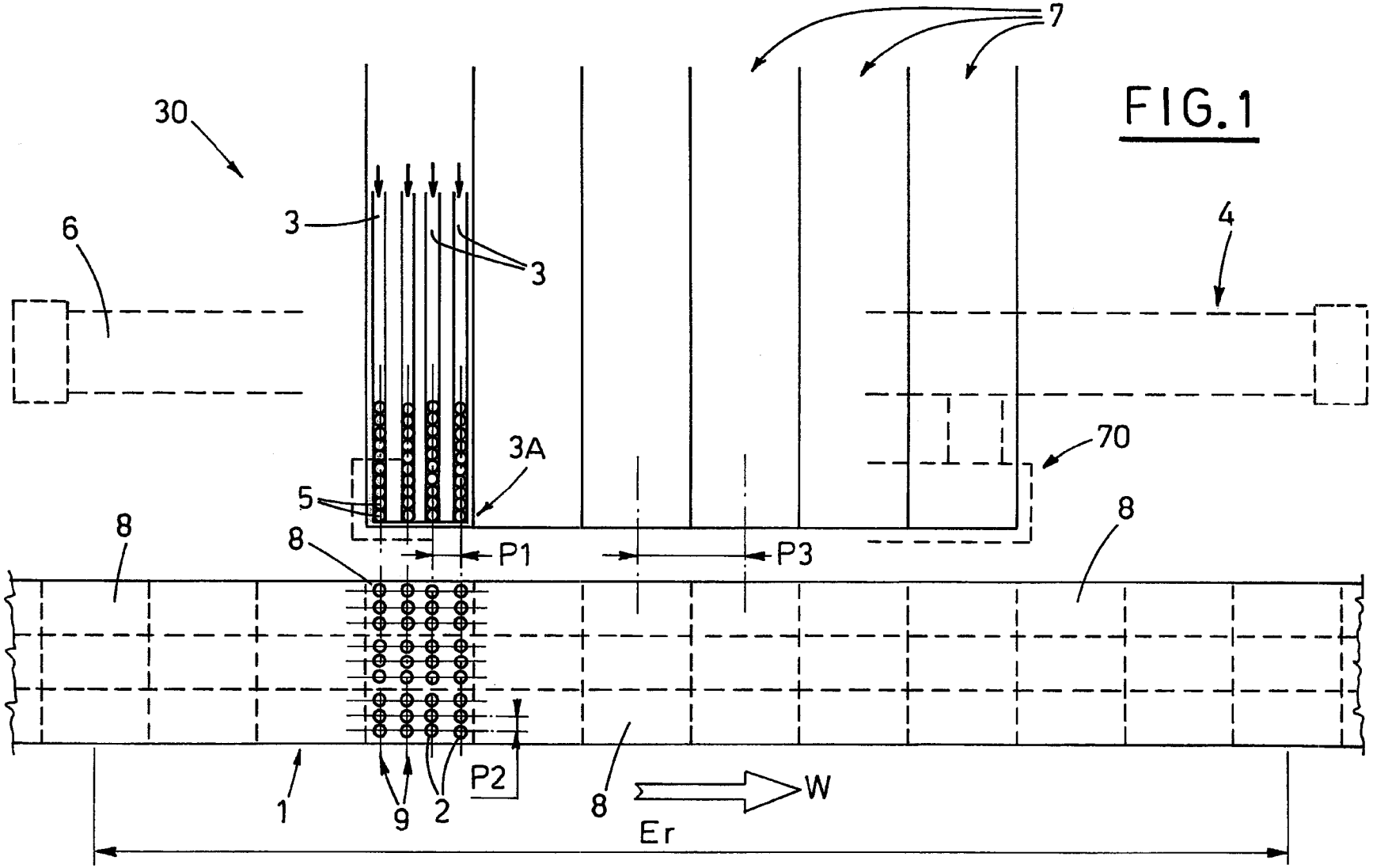
FIG. 1 is a schematic plan view of an apparatus of the present invention, and of a heat-formed blister strip which is advancing at a predetermined operating speed.

In the example shown (see FIG. 1 in particular) the dotted lines delimit identical portions 8 of blister strip 1 defining corresponding blister packs which will be formed in successive operating stations (not shown since they are not pertinent to the invention); the transversal outline of the blister strip 1 is defined by a whole number (3, in the example shown) of portions 8 of blister strip 1, while the cells 2 of each portion 8 of heat-formed strip 1 are reciprocally arranged at a first distance P1 longitudinally, and at a second distance P2 transversally to the extension of the strip 1.

The reference number 30 is used generically to indicate an apparatus which is an object of this invention. The apparatus is arranged laterally near a section traversed by the blister strip 1, and comprises: a plurality of accumulation channels 3, which are rigidly constrained to a frame (not shown) of the apparatus 30 of the invention, articles 5 (for example pills, tablets, capsules and the like) being contained in line and in mutual contact in the channels, and destined to fill corresponding cells 2 of the blister strip 1; and a robotic device or organ 4, which is shown only schematically in the appended figures since it is substantially of a known type (see U.S. Pat. No. 6,948,608 belonging to the Applicant); the organ 4 is of the three-axle type and is slidingly mounted on a guide 6 (see FIG. 1), which guide is constrained to the frame of the apparatus 30, parallel to the advancement direction W of the blister strip 1, and acts between the terminal sections 3A of the accumulation channels 3, where it collects a predetermined number of articles 5, and predetermined identical adjacent longitudinal regions R1, R2, R3 of the blister strip 1, which comprise a same number of empty cells 2 to be filled.

The accumulation channels 3 are arranged inside container modules 7, are identical to each other, and are constrained to the frame; each module has the same number of accumulation channels 3 as the number of transversal rows 9 on a portion 8 of blister strip.

The accumulation channels 3 (four in the example shown) contained within each module 7 are reciprocally parallel and are distanced by the same amount as the transversal rows 9 of cells 2 of a portion of blister strip 1, that is by the first distance P1. The container modules 7, of which a certain number is provided (six in the example shown), are distanced from one another by a distance P3 which is the same as the distance between the portions 8 (FIG. 1), are arranged side by side, and are oriented perpendicular to the advancement direction W of the blister strip 1.

As specified above, the blister strip 1 is obtained by means of a series of heat-forming operating stages; each stage provides a longitudinal zone of heat-formed strip, which is constituted by a predetermined number of portions 8 which are oriented in transversal and longitudinal rows: advantageously the number of container modules 7 is the same as, or a multiple of, the number of portions 8 provided in a longitudinal row of each zone of heat-formed strip.

The device 4 comprises gripping organs 70, for example sucker means, which are connected to a source of depression, and which collect a number of articles 5 from each accumulation channel 3 at the terminal sections 3A thereof, the number of articles 5 for each accumulation channel corresponding for example to the number of cells 2 on a transversal row of a portion 8 of blister strip 1 (three in the example shown). As already described, the regions R1, R2, R3 of blister strip 1 are identical, each being constituted by the same number of consecutively arranged portions 8 of blister strip 1 as the number of container modules 7 which are provided in the apparatus 30 (six in the example shown); the regions R1, R2, R3 are arranged adjacent to each other and all together define a complete longitudinal tract T of blister strip 1.

Figures 2, 3:
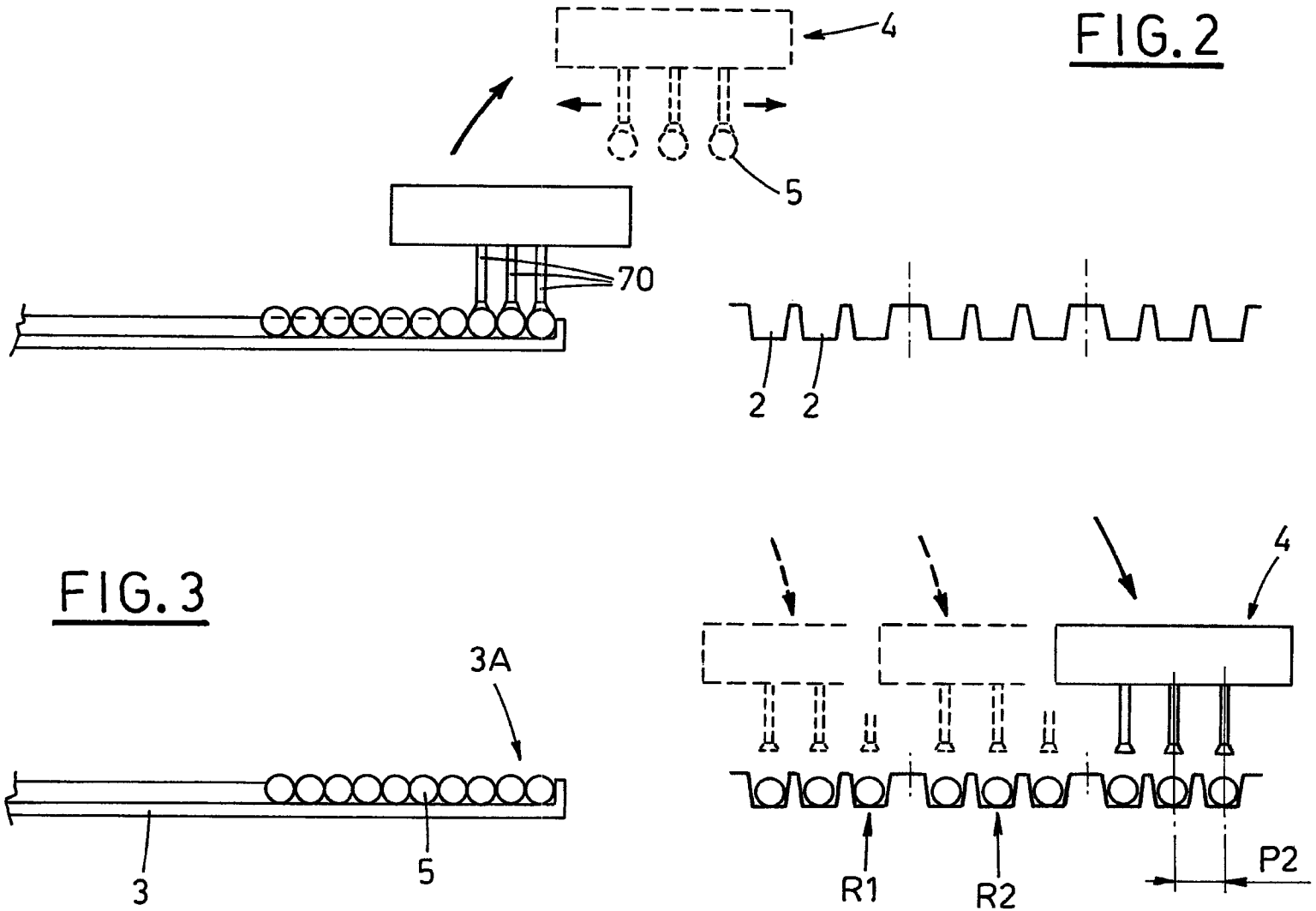
FIGS. 2, 3 are schematic views of a transversal section of the apparatus and of the strip of FIG. 1, which show the stages of collecting the articles, adjusting the position of the collected articles and releasing the articles into corresponding cells of the advancing strip according to the method which is also an object of this invention.

The organs 70 also adjust the reciprocal transversal position of the articles 5 once these have been collected from the relative accumulation channels 3, so as to distance the articles 5 by the second distance P2 (FIGS. 2, 3) in the direction of reciprocal contact thereof, that is in the transversal direction, so that the spatial arrangement of the collected articles 5 corresponds perfectly to that of the empty cells 2 of the longitudinal region R1, R2, R3 which are to be filled. The apparatus 4 consequently positions itself above the advancing blister strip 1, follows the strip 1 and synchronizes itself there-with in a centered position relative to the underlying corresponding longitudinal region R1, R2, R3, and then (after lowering, if necessary) releases the collected articles 5, suitably distanced from one another, into the corresponding empty cells 2 of the region R1, R2, R3.

The maximum longitudinal travel which the apparatus 4 imposes on the organs 70 is indicated by $E_R$.

The functioning of the apparatus 30, which is an object of the present invention, is defined by the following description of the method for filling the cells of a heat-formed strip which the apparatus implements, the method also being an object of the invention. The method is destined to be implemented continuously and cyclically, a longitudinal tract T of the blister strip 1 being filled during the operations relative to each operating cycle; the blister strip 1, as mentioned above, is constituted in the shown example by the identical adjacent regions R1, R2, R3.

Figure 4A:
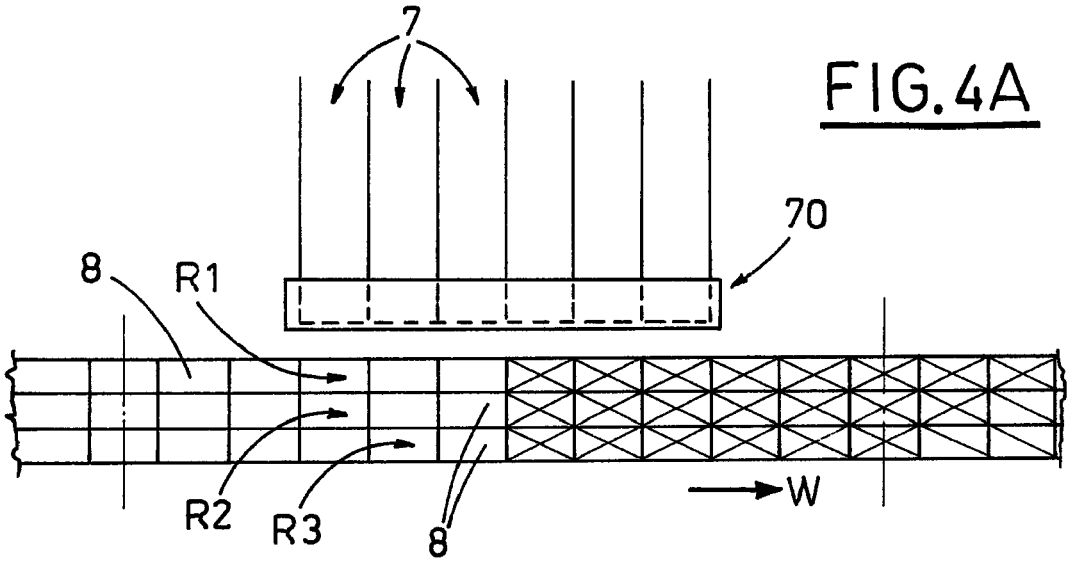
FIGS. 4A, 4B, 4C are schematic plan views of the apparatus and of the strip of FIG. 1 on a different scale, which show the filling operations for a first region of the blister strip which is advancing at operating speed, in accordance with the method of this invention.
Figure 4B:
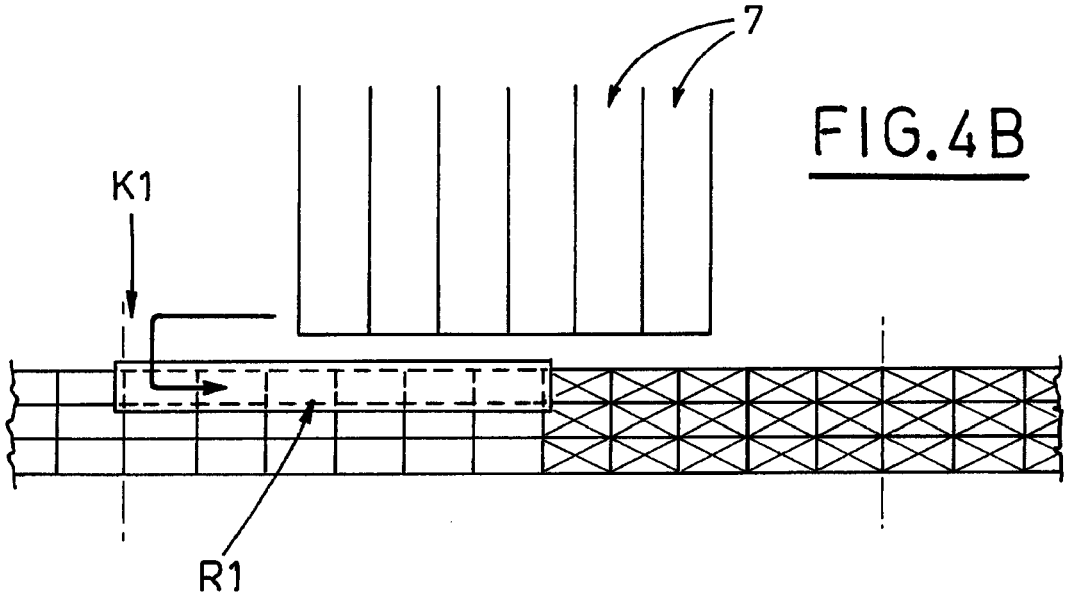
Figure 4C:
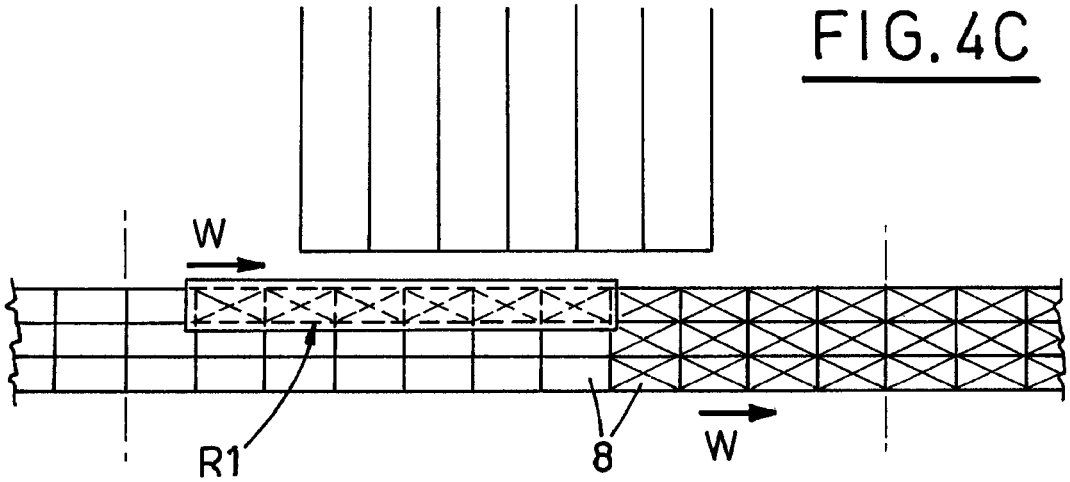
Figure 5A:
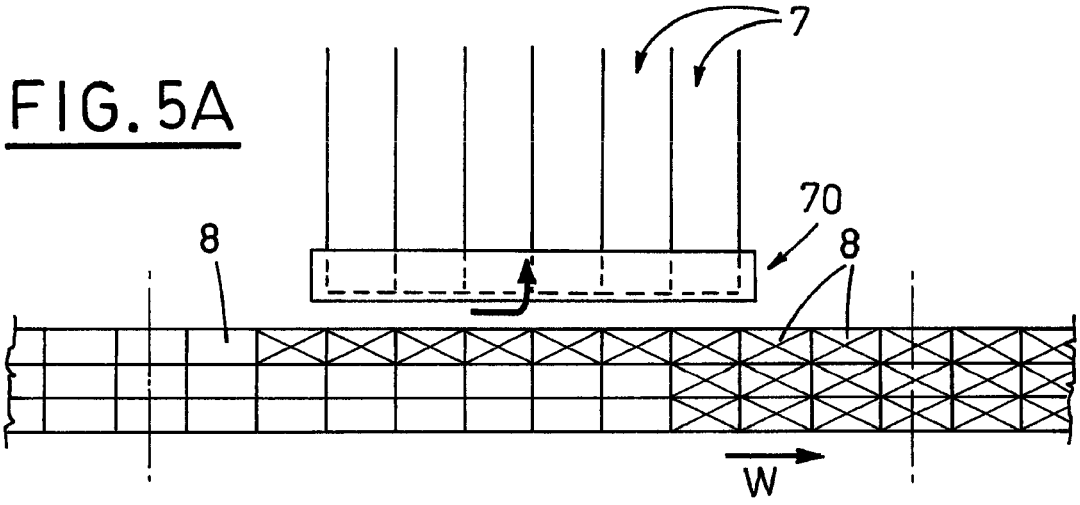
FIGS. 5A, 5B, 5C and FIGS. 6A, 6B, 6C, similarly to the previous figures, show the operations for filling a second and third region of the blister strip respectively, completing an operating cycle to fill a particular longitudinal tract of the blister strip.
Figure 5B:
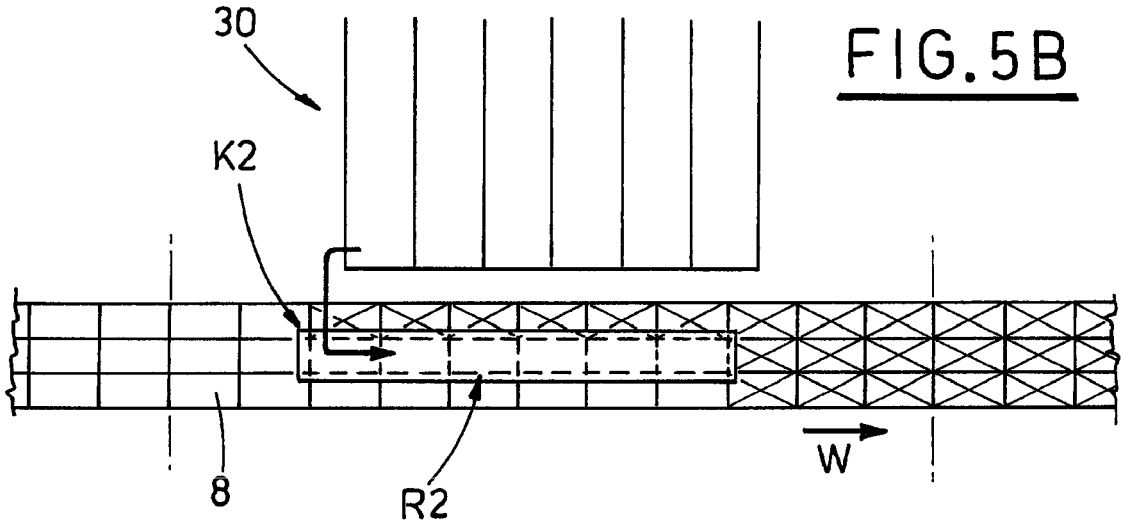

In detail, the method includes:

contemporaneously collecting a plurality of articles 5 from the terminal sections 3A of the accumulation channels 3, the same number of articles 5 being collected from each channel 3 as the number of cells 2 in a transversal row 9 of a portion 8 of blister strip 1;

adjusting a reciprocal position occupied by the collected articles 5 in order to distance the articles 5 by the second distance P2 with respect to their direction of mutual contact, that is the transversal direction (FIG. 3), in such a way that the spatial arrangement of the articles 5 corresponds to that of the empty cells 2 of any of the longitudinal regions R1, R2, R3 to be filled;

transferring the collected articles 5 to a position above the blister strip and aligned with the first longitudinal region R1 and then conveying the articles 5 in the same direction as an advancement direction of the blister strip 1 up until a velocity of the articles 5 is synchronized with a velocity of the blister strip 1, the articles 5 being centered with respect to empty cells of the underlying first region (see FIG. 4B);

releasing the collected articles 5 (after lowering them, if necessary) which are positioned one relative to the other as specified above, into corresponding cells 2 of the first region R1 (see FIG. 4C);

repeating the above-mentioned operating stages for the remaining second longitudinal region R2 (see FIGS. 5A, 5B, 5C) which is identical and adjacent to the first region R1, and for the remaining third longitudinal region R3, which is identical and adjacent to the second region R2 (see FIGS. 6A, 6B, 6C), thus completing the process of filling the longitudinal tract of blister strip 1.

To fill the first region R1, the organs 70 are positioned above the blister strip and aligned with the first region R1, in their most retracted position K1 with reference to the maximum travel $E_R$ imposed on the organs 70 (FIG. 4B); subsequently the organs follow the strip until they are synchronized with the velocity of the strip, in a centered position-relative to the region R1, and then they are lowered in order to allow release of the articles into the cells of the first region R1 (FIG. 4C).

Figure 5C:
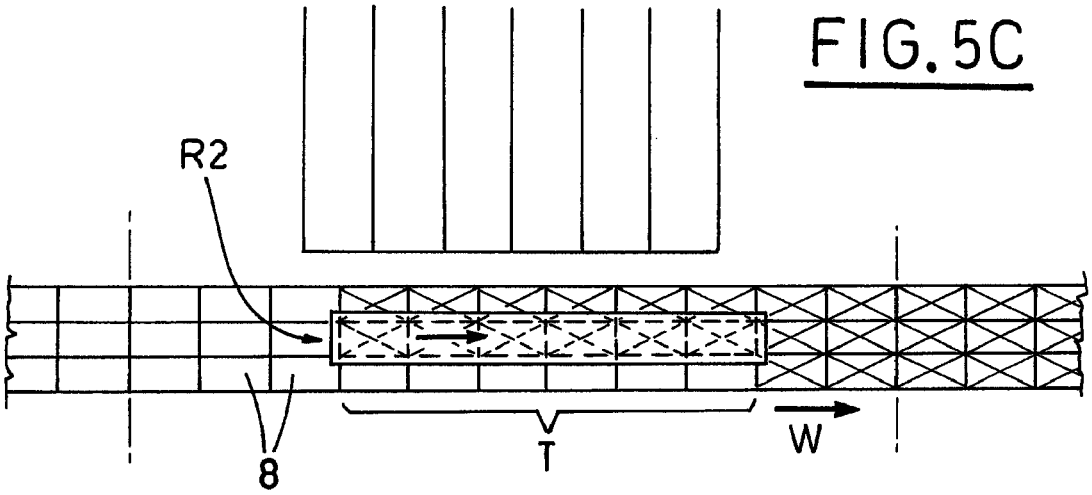
Figure 6A:
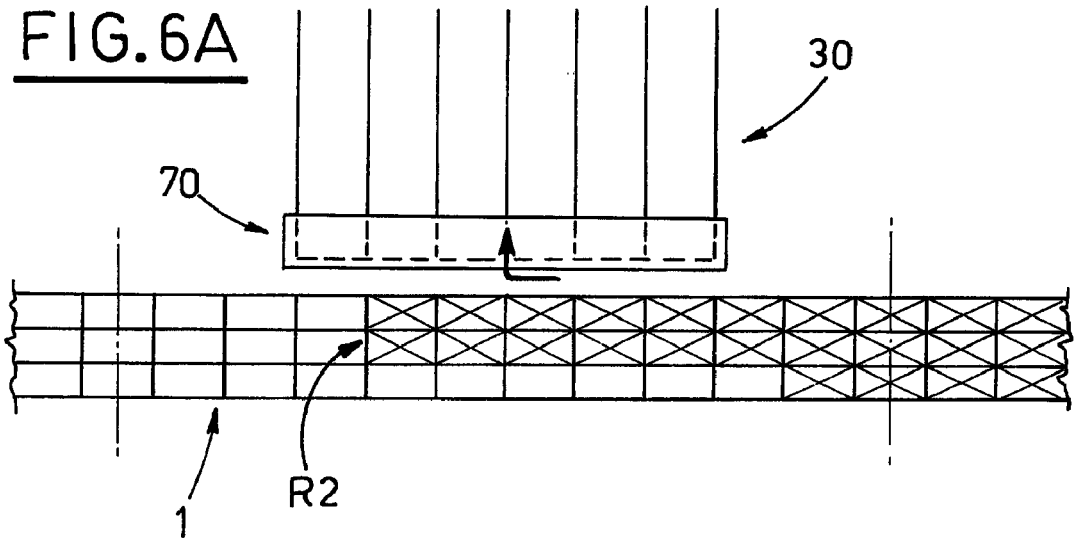
Figure 6B:
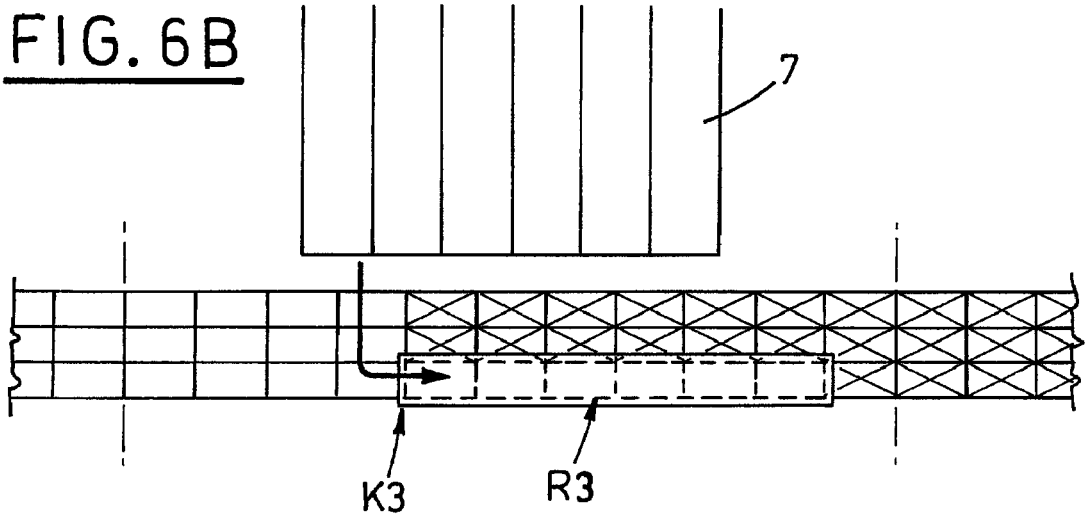
Figure 6C:
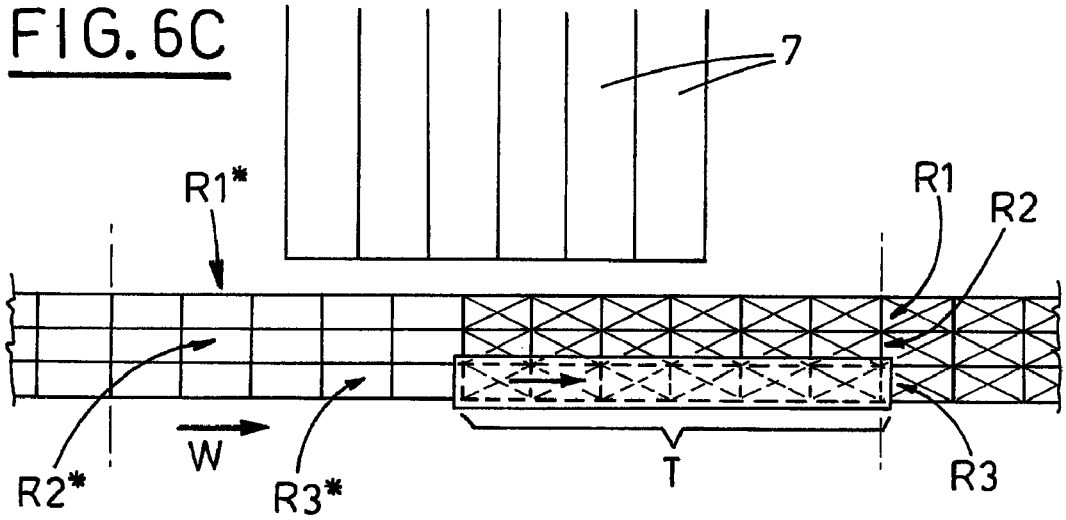

To fill the second region R2 of the strip 1, the organs 70 are positioned above the blister strip, and aligned with the second region R2, in an intermediate initial position K2, situated downstream of the retracted position K1 (FIG. 5B); the subsequent operations are the same as those described for the first region R1; in this way the articles are released into the cells of the second region R2 (FIG. 5C).

Finally, to fill the third region R3, the organs 70 are positioned above the blister strip, aligned with the third region R3, in an advanced position K3 which is situated downstream of the intermediate position K2: upon termination of the release of the articles into the cells of the third region R3 (FIG. 6C), the organs 70 are situated near the downstream end of their maximum travel $E_R$.

The third region R3 having been filled, the abovementioned operations are performed again, care being taken that the new regions R1*, R2*, R3* (FIG. 6C) are correspondingly arranged in good order behind the previous regions.

To sum up, the cells are filled by successively filling the cells of regions R1, R2, R3, which extend longitudinally, are mutually side-by-side and identical, and define an overall longitudinal tract T of the strip 1, all of the foregoing taking place with the strip 1 in continuous movement, which has positive effects on the productivity of the operation of filling the cells with articles.

In the example shown, the number of articles which is collected by the organs 70 from each channel 3 is the same as the number of cells which is provided in each transversal row 9 of the portion 8 of the strip 1; this is extremely advantageous, since during each operating stage of the method, only the cells relative to portions 8, which will constitute corresponding blisters packs, are filled.

Clearly it is possible to collect a number of articles from each channel which differs from the number mentioned above, so long as the number is the same as, or a submultiple of, the number of cells provided in each transversal row of blisters of the strip 1.

In the example shown, the number of container modules 7 is the same as, or a multiple of, the number of portions 8 provided in a longitudinal row of each zone of strip which is obtained in each heat-forming stage the strip undergoes: this is advantageous for the reliability and productivity of the method provided; obviously the method can be implemented even if the number of modules does not fulfill the just-described condition.

Finally, according to a constructional variant, the parallel accumulation channels 3 which are contained inside each module 7 can also be arranged at a distance which differs from the first distance P1: in this case, the apparatus 30 will have organs 70 which are capable of suitably adjusting the position of the articles 5 which are collected from the accumulation channels 3 each time, so that the position of the articles 5 is the same as the spatial arrangement of the empty cells 2 of the region R1, R2, R3 to be filled.

The advantage of this invention consists in having defined a method of new conception for filling the cells of a heat-formed strip, which method is constituted by an essential number of operating stages, and the implementation of which provides high reliability and productivity at relatively low costs compared with the advantages which are obtained.

Another advantage of this invention consists of having defined an apparatus to implement the abovementioned method, which apparatus is reliable, functional, versatile and productive, the costs of which are low if compared with the advantages secured.

Note that format changeover of the blister strip 1, that is to say, varying the reciprocal arrangement of the cells provided in the strip, requires substitution of only the gripping organs 70; varying the dimension of the articles 5 makes it necessary to vary and/or substitute the channels 3.

Note also that the method which is an object of this invention and the apparatus which implements the method, also an object of the invention, can be adapted to a wide range of applications, depending on the number of portions 8 of strip 1 identified transversally to the extension of the blister strip 1; and depending on the characteristics of each portion 8 of strip 1 in terms of the dimensions, number and arrangement of the cells 2 contained therein (the number of cells 2 for each relative longitudinal and transversal row). Thus also the regions of blister strip 1 which as a whole and on each occasion identify a specific longitudinal tract T of strip 1 can vary in terms of number and dimensions, according to production needs and requirements: in other words, instead of three regions R1, R2, R3 as in the example shown, the longitudinal portion T of the strip can be defined by two regions or by four or more regions, the cells of these regions being involved in the relative operating stages for filling as described above.

The foregoing in any case is intended as a non-limiting example, thus any modifications to details which it should become necessary to adopt, for practical and/or applicational reasons, must be considered as being included in the ambit of protection defined by the following claims.

What is claimed:

1. A method for filling cells of a blister strip with corresponding articles, the blister strip being continuously advanced along an advancement direction at a predetermined operating speed, which comprises in order:

contemporaneously collecting a plurality of articles in reciprocal contact which are arranged in a plurality of distinct parallel rows, a predetermined number of articles destined for collection corresponding to each row;

adjusting reciprocal positions occupied by the articles after collection in such a way that the articles are arranged in a same spatial arrangement as a same number of empty cells of a predetermined first longitudinal region of the blister strip;

transferring the collected articles to a position which is above the blister strip and aligned with the first longitudinal region to be filled, and conveying the articles in a same direction as an advancement direction of the blister strip until synchronization with an operating speed of the blister strip is achieved, the articles being centered relative to the cells of the underlying first region;

releasing the articles into corresponding cells of the first region;

repeating the above-listed operating stages in order to fill cells of at least a second longitudinal region of the blister strip, which region is identical and adjacent to the first region, thus completing a filling of the cells of a longitudinal tract of the blister strip which the first and second regions constitute;

repetition of the filing stages on further consecutive, longitudinal tracts of the blister strip.

2. The method of claim 1, wherein the release operation is preceded by the articles being lowered towards the corresponding underlying longitudinal region of the blister strip.

3. The method of claim 1, further comprising reciprocally distancing the parallel rows of the articles equal to a distancing of transversal rows of the cells of the first region and the second region, the parallel rows being perpendicularly oriented relative to the advancement direction of the heat-formed blister strip, and wherein the adjusting of a reciprocal position which is occupied by the collected articles distances the articles only relative to the direction of mutual contact thereof, which direction is transversal to the advancement direction of the blister strip.

4. The method of claim 1, wherein a number of the articles which is collected from each row is a submultiple of the number of the cells which are contained in a transversal row of the blister strip.

* * * * *